US008025337B2

(12) United States Patent
LaPointe et al.

(10) Patent No.: US 8,025,337 B2
(45) Date of Patent: Sep. 27, 2011

(54) ADJUSTABLE HEAD REST ASSEMBLY FOR FURNITURE MEMBER

(75) Inventors: Larry P. LaPointe, Temperance, MI (US); Chad Edward Adams, Perrysburg, OH (US); Mark D. McClung, Grandview, TN (US)

(73) Assignee: La-Z-Boy Incorporated, Monroe, MI (US)

( * ) Notice: Subject to any disclaimer, the term of this patent is extended or adjusted under 35 U.S.C. 154(b) by 420 days.

(21) Appl. No.: 12/338,392

(22) Filed: Dec. 18, 2008

(65) Prior Publication Data

US 2010/0156161 A1 Jun. 24, 2010

(51) Int. Cl.
*A47C 7/36* (2006.01)

(52) U.S. Cl. ..... 297/408

(58) Field of Classification Search ..... 297/408, 297/410, 61, 391
See application file for complete search history.

(56) References Cited

U.S. PATENT DOCUMENTS

| | | | | |
|---|---|---|---|---|
| 711,412 | A * | 10/1902 | Archambeault | 297/61 |
| 3,713,666 | A * | 1/1973 | Cheers et al. | 280/124.177 |
| 4,718,716 | A * | 1/1988 | Stumpf et al. | 297/85 R |
| 5,217,278 | A | 6/1993 | Harrison et al. | |
| 5,464,269 | A * | 11/1995 | Mizelle | 297/61 |
| 5,664,841 | A * | 9/1997 | Dal Monte | 297/408 |
| 6,860,564 | B2 | 3/2005 | Reed et al. | |
| 7,131,694 | B1 | 11/2006 | Buffa | |
| 7,866,742 | B2 * | 1/2011 | LaPointe | 297/61 |
| 2009/0184555 | A1 * | 7/2009 | Yetukuri et al. | 297/408 |

FOREIGN PATENT DOCUMENTS

| | | |
|---|---|---|
| JP | 2004-350792 | 12/2004 |
| WO | WO94/21153 | 9/1994 |
| WO | WO2008/111848 | 9/2008 |

OTHER PUBLICATIONS

International Search Report for International Application No. PCT/US2009/065237 mailed Jul. 9, 2010.
Written Opinion of the International Searching Authority for International Application No. PCT/US2009/065237 mailed Jul. 9, 2010.

* cited by examiner

*Primary Examiner* — Milton Nelson, Jr.
(74) *Attorney, Agent, or Firm* — Harness, Dickey & Pierce, P.L.C.

(57) ABSTRACT

A system for moving a furniture member headrest includes an armrest fixedly connected to a base. A back support is connected to the armrest. A headrest is movably connected to the back support. A first adjustment member operates to rotate the headrest. The first adjustment member is positioned in a cavity between interior and exterior armrest frame elements and is manually movable. A second adjustment member moves the headrest upwardly or downwardly with respect to the backrest. The second adjustment member is also positioned in the cavity and manually movable by the occupant.

27 Claims, 16 Drawing Sheets

ADJUSTABLE HEAD REST ASSEMBLY FOR FURNITURE MEMBER

FIELD

The present disclosure relates to headrest assemblies for furniture members.

BACKGROUND

This section provides background information related to the present disclosure which is not necessarily prior art.

Conventionally, reclining articles of furniture (i.e., chairs, sofas, loveseats, and the like), referred to hereinafter generally as reclining chairs, utilize a mechanism to bias a leg rest assembly in extended and stowed positions and separate components to allow a back seat member to recline with respect to a seat base. Known furniture members can also include mechanism designs that also permit the reclining chair to rock in a front-to-back motion with respect to an occupant. Occupant headrest support is commonly provided by one or more cushion members which abut with or are extensions of further cushion members acting as occupant back rest support members. The headrest support is commonly joined at its ends to vertically oriented backrest side support arms which are in turn rotatably connected to a furniture member chair frame.

Most reclining chairs upholster the chair frame and support the chair frame from a stationary base assembly in a manner permitting the chair frame to "rock" freely with respect to the base assembly. In order to provide enhanced comfort and convenience, many rocking chairs also include a "reclinable" seat assembly and/or an "extensible" leg rest assembly. For example, combination platform rocking/reclining chairs, as disclosed in Applicant's U.S. Pat. Nos. 3,096,121 and 4,179,157, permit reclining movement of the seat assembly and actuation of the leg rest assembly independently of the conventional "rocking" action. The leg rest assembly is operably coupled to a drive mechanism to permit the seat occupant to selectively move the leg rest assembly between its normally retracted (i.e., stowed) and elevated (i.e., extended or protracted) positions.

Because headrest support is substantially fixed to the back seat member, as the back seat member rotates the headrest cushion(s) will commonly remain in a fixed orientation with respect to the seat back member. This can result in uncomfortable headrest support positions for the different rotated positions of the seat back. For example, with the seat back member rotated to a fully reclined position, the headrest may be rotated too far backward for comfortable viewing of a television or monitor. Also, with the seat back member rotated to a fully upright position, the headrest may be rotated too far forward for the comfort level desired by the occupant. The above headrest support systems are not adjustable by the occupant, and therefore can result in discomfort in either the fully reclined or fully upright positions, or in the leg rest extended position for different occupants.

SUMMARY

This section provides a general summary of the disclosure, and is not a comprehensive disclosure of its full scope or all of its features. Co-pending disclosures corresponding to U.S. patent application Ser. No. 12/338,321 and, corresponding to U.S. patent application Ser. No. 12/338,545, each filed on the same date as the present disclosure, Dec. 18, 2008 are commonly assigned to the assignee of the present disclosure. The entire disclosures of each of the above applications are incorporated herein by reference.

According to at least one embodiment of the present disclosure, a system for moving a headrest assembly of a furniture member includes an armrest portion of the furniture member. A back support portion is connected to the armrest portion. A headrest portion is movably connected to the back support portion. A first adjustment member operates to rotate the headrest portion. The first adjustment member is positioned in a cavity created between interior and exterior armrest frame elements of the armrest portion, and the first adjustment member manually movable by an occupant of the furniture member.

According to other embodiments, a system for moving a headrest assembly of a furniture member includes an armrest portion fixedly connected to a base portion of the furniture member. A back support portion is connected to the armrest portion. A headrest portion is movably connected to the back support portion. A first adjustment member operates to rotate the headrest portion. The first adjustment member is positioned in a cavity created between interior and exterior armrest frame elements of the armrest portion and is manually movable by an occupant of the furniture member. A second adjustment member operates to upwardly and downwardly move the headrest portion with respect to the backrest portion. The second adjustment member is positioned in the cavity and is manually movable by the occupant.

According to still other embodiments, a furniture member headrest control system includes a mechanism having at least first and second lever members. An actuation assembly connected to the first lever member. An actuation link is connected between the actuation assembly and a headrest portion. Manual movement of the first lever member operates to rotate the headrest portion between a rearward rotated position and a forward rotated position. A cable links the second lever member to a headrest subassembly of the headrest portion. Manual movement of the second lever member operates to displace the cable thereby displacing the headrest subassembly between a downward position and an upward extended position.

According to still other embodiments, a method for adjusting a position of a headrest portion of a furniture member includes displacing the first lever member in the first direction to rotate the headrest assembly from a headrest back position to a headrest forward rotated position; restraining the headrest portion in a headrest retracted position against a biasing force of a biasing element; and displacing the second lever member in the first direction to allow the biasing force of the biasing member to upwardly extend the headrest portion away from the back support portion to a headrest extended position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
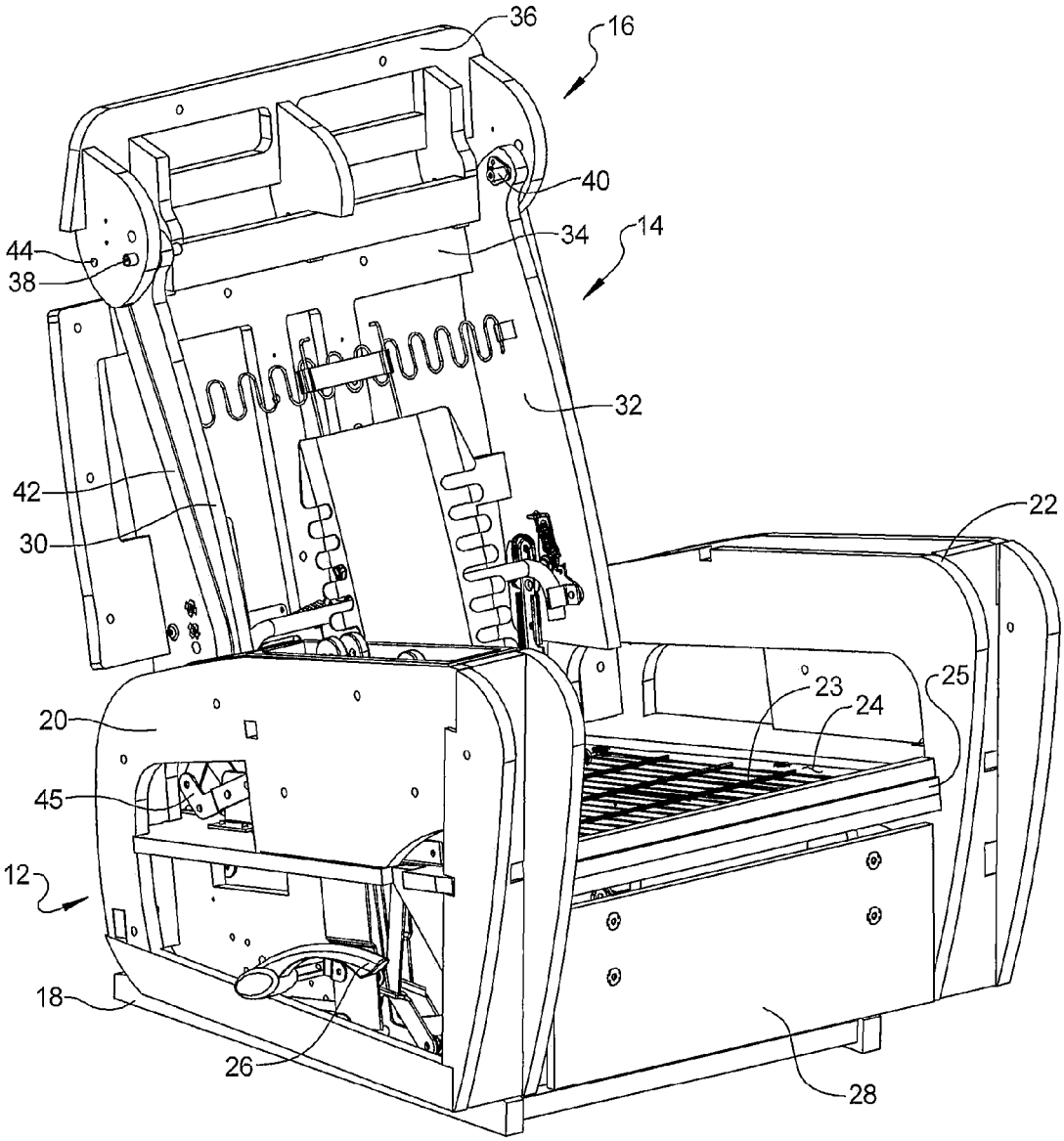
FIG. 1 is a front right perspective view of a furniture member having a lumbar support system of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Referring generally to FIG. 1, a furniture member 10 of the present disclosure is presented generally in the form of a rocking, reclining chair, however furniture member 10 can be any type of seating or occupant support member including a sofa, love-seat, sectional member, non-rocking reclining chair, or the like. Furniture member 10 includes a base portion 12 which rotatably supports a back support portion 14. A headrest portion 16 is movably connected to back support portion 14. A base support section 18 that supports the base portion 12 can be positioned on a planar surface such as a floor. First and second armrest members 20, 22 are directly connected to base portion 12 and provide occupant arm support and additional features that will be further described herein.

A plurality of sinuous wire members 23 can be suspended over a cavity 24 created within a frame pan 25 of base portion 12. Sinuous wire members 23 provide vertical support for the weight of an occupant of furniture member 10. According to several embodiments, sinuous wire members 23 are made of a spring steel material. When the weight of the occupant is supported by sinuous wire members 23, back support portion 14 provides a back or back rest support for an occupant of furniture member 10. A leg rest extension device 26 such as a hand lever or switch which is connected to a leg rest mechanism 27 can be used to extend and/or retract an occupant leg rest 28 (shown in a fully retracted position).

Back support portion 14 can be formed from wood members such as first and second side frame members 30, 32 which are connected to a rear frame member 34. A headrest frame 36 is movably connected to rear frame member 34. A support position of headrest frame 36 can be varied from the fully rearward rotated position shown in FIG. 1 to a forward rotated position and an upward extended position to be described with reference to FIGS. 4-10 at the discretion of the occupant of furniture member 10. Headrest frame 36 is rotatably connected to first and second side frame members 30, 32 using first and second headrest pins 38, 40. Headrest frame 36 is rotated by displacement of an actuation link 42 which is rotatably connected at a first end to headrest frame 36 by a link pin 44, and at a second end to an actuation assembly 45.

Figure 2:
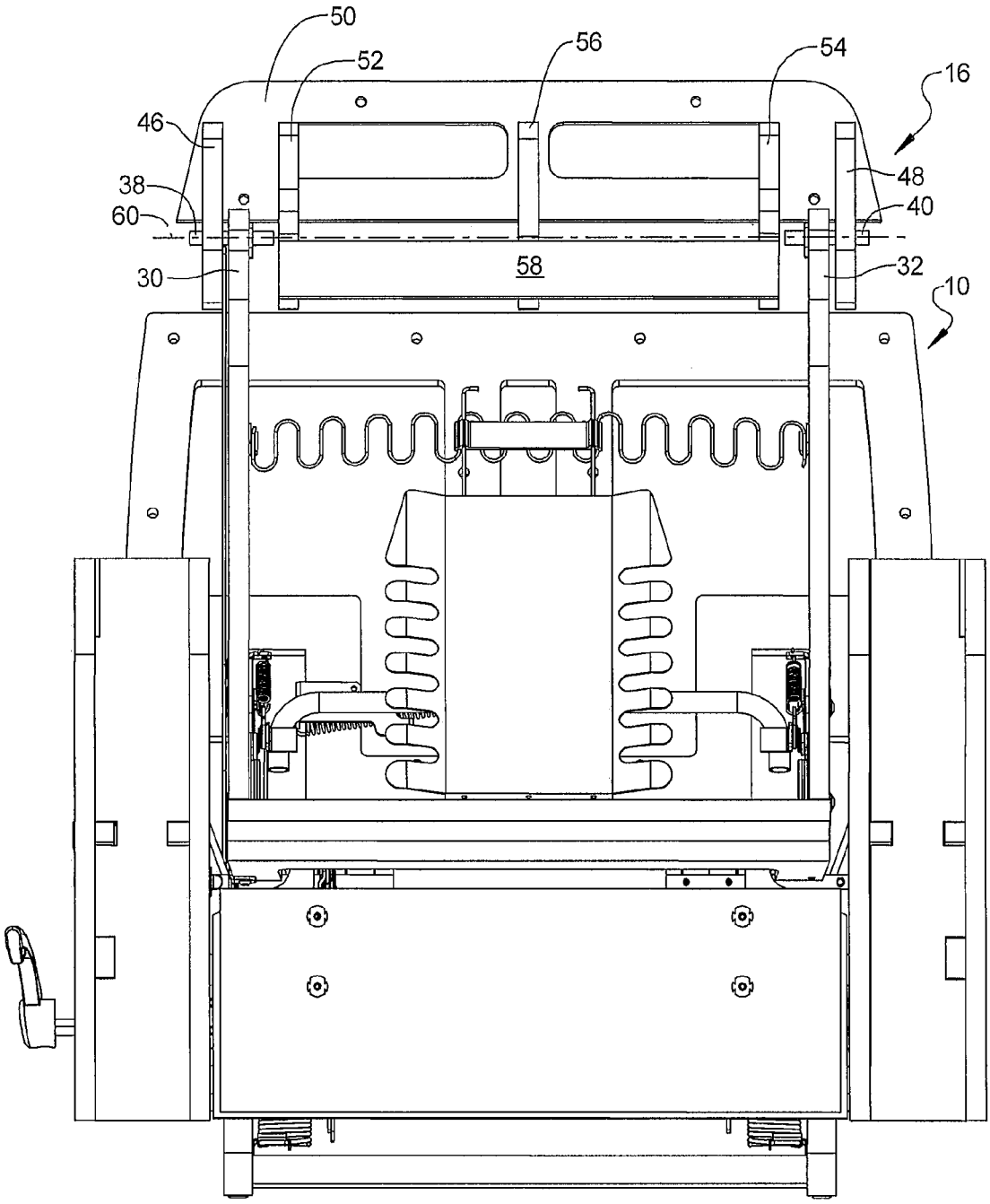
FIG. 2 is a front elevational view of the furniture member of FIG. 1.

Referring to FIG. 2, headrest portion 16 further includes a first headrest side frame member 46 through which first headrest pin 38 is disposed, and a second headrest side frame member 48 through which second headrest pin 40 is disposed. A headrest rear frame member 50 is fixedly connected to first and second headrest side frame members 46, 48. A first stiffening member 52 and a second stiffening member 54 can be provided proximate to first and second headrest side frame members 46, 48 to provide additional stiffness for headrest portion 16. A brace member 56 can be centrally positioned on headrest rear frame member 50 to serve a similar function to first and second stiffening members 52, 54. A headrest forward member 58 is connected to each of the first and second stiffening members 52, 54 and also to brace member 56. A common pin longitudinal axis 60 created through each of first and second headrest pins 38, 40 define an axis of rotation for headrest portion 16. Headrest portion 16 can rotate forwardly and rearwardly (toward the viewer and away from the viewer as viewed in FIG. 2) by rotation about first and second headrest pins 38, 40.

Figure 3:
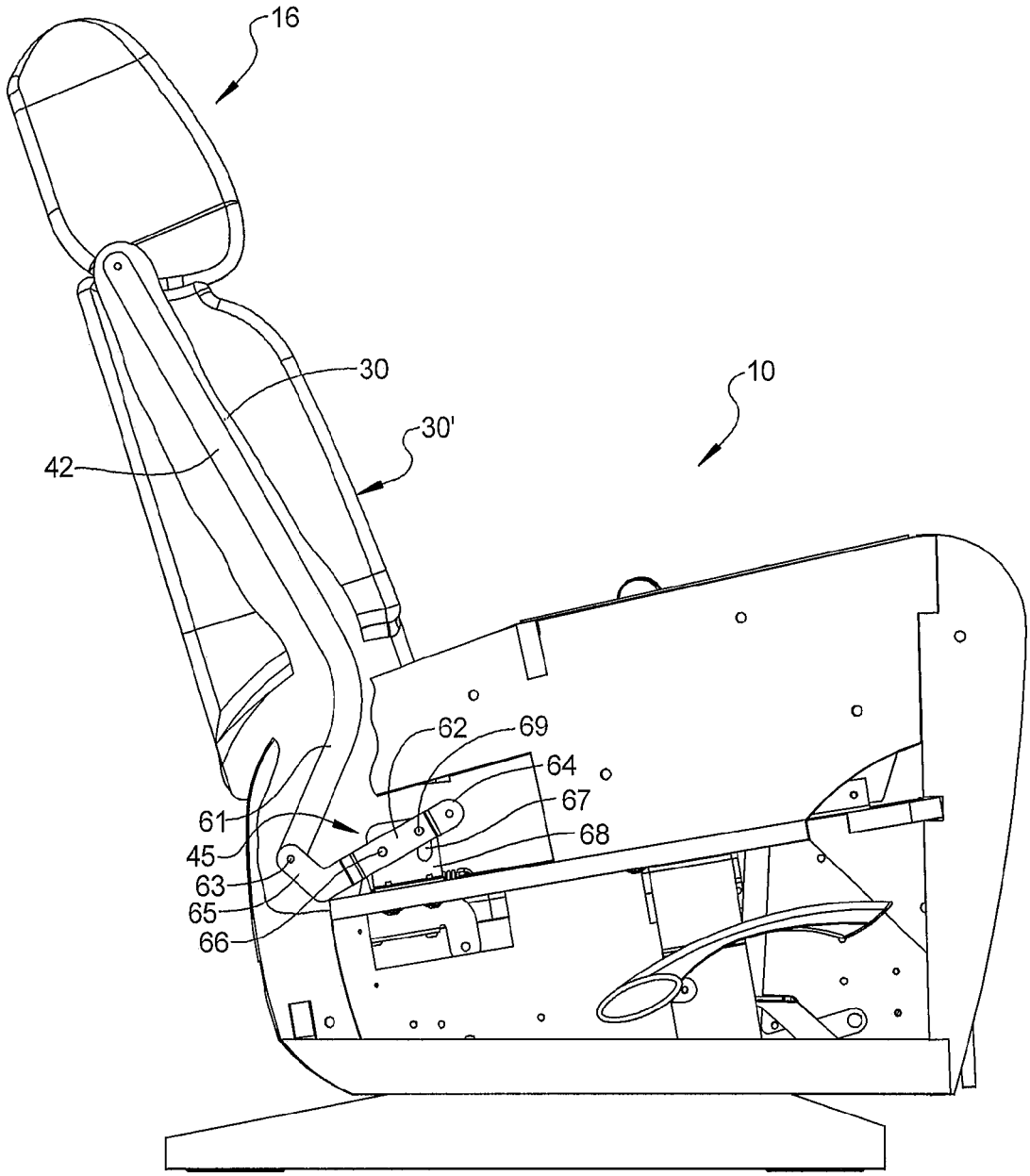
FIG. 3 is a side elevational view of the furniture member of FIG. 1 showing the headrest assembly in a fully rearward rotated position.

Referring to FIG. 3, to allow for displacement motion of actuation link 42 to rotate headrest portion 16, an intermediate bend portion 61 is provided in actuation link 42. Intermediate bend portion 61 allows motion of actuation link 42 to be retained within a space envelope of first side frame member 30 such that motion of actuation link 42 is contained within an upholstered boundary of first side frame member 30 so that most of actuation link 42 is not visible to an observer. An actuation arm 62 is connected to the second end of actuation link 42 using a connecting pin 63 which allows rotational movement between actuation link 42 and actuation arm 62. When movement of headrest portion 16 is desired by the occupant of furniture member 10, a force is provided to a force receiving end 64 of actuation arm 62 which is transferred to a force transmitting end 65 of actuation arm 62. Actuation arm 62 rotates about a rotational axis defined through a rotation pin 66 which connects actuation arm 62 to a bracket 68. An arcuate slot 67 provided in bracket 68 receives an extending pin 69 which is directly connected to and transversely extends from actuating arm 62. Arcuate slot 67 provides positive stops for the rotational displacement of actuation arm 62 by contact of extending pin 69 with the oppositely positioned ends of arcuate slot 67. FIG. 3 shows a fully rearward rotated position of headrest portion 16 provided when extending pin 69 contacts the upper end of arcuate slot 67.

Figure 4:
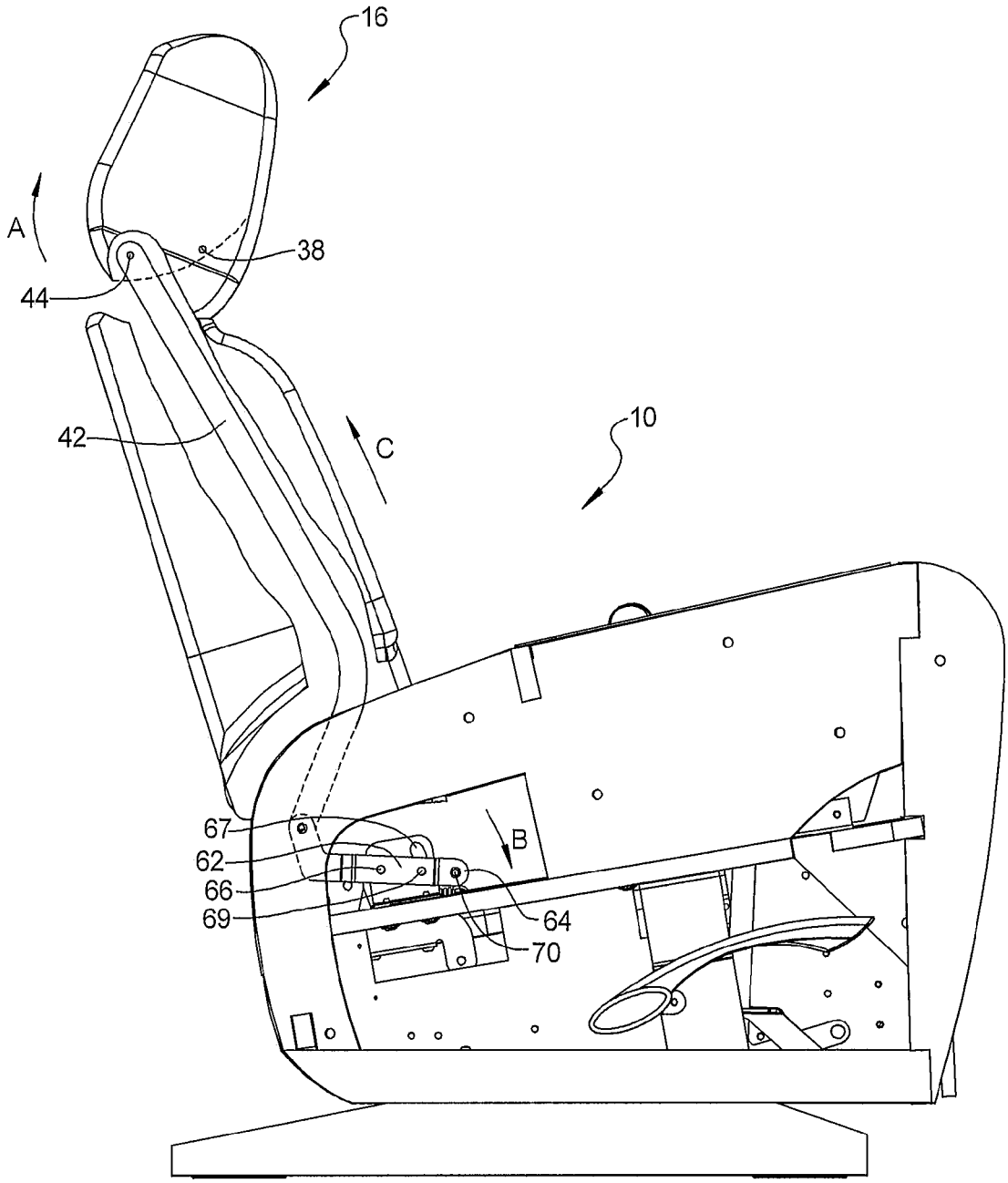
FIG. 4 is a side elevational view of the furniture member of FIG. 1 showing the headrest assembly in a fully forward rotated position.

Referring to FIG. 4, to rotate headrest portion 16 in a forward rotation direction "A", the occupant applies force causing the force receiving end 64 of actuation arm 62 to rotate in an actuation direction "B". Actuation arm 62 rotates clockwise as viewed in FIG. 4 about the rotational axis defined by rotation pin 66 which displaces actuation link 42 in a link displacement direction "C". Displacement of actuation link 42 transmits the force through link pin 44 to rotate headrest portion 16 in a clockwise direction about first headrest pin 38 which rotates headrest portion 16 in the forward rotational direction "A". Forward rotation of headrest portion 16 continues until extending pin 69 contacts the lower end of arcuate slot 67. Headrest portion 16 is shown in a furthest forward rotated position in FIG. 4. The force acting to displace actuation arm 62 can be applied through a drive connector aperture 70 for example by a pin or similar connector (not shown in this view).

Figure 5:
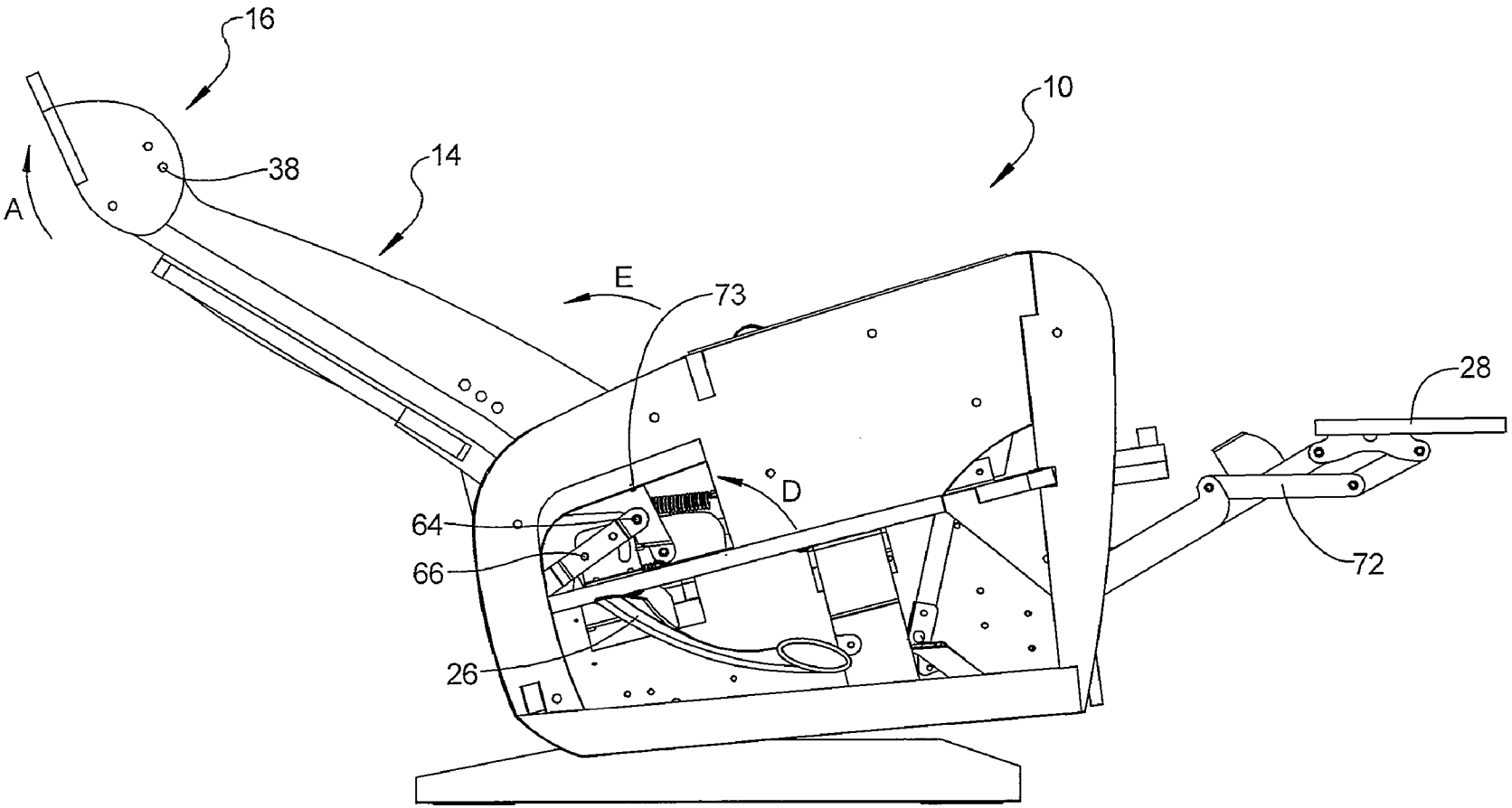
FIG. 5 is a side elevational view of the furniture member of FIG. 1 showing the back support portion rotated to the fully reclined position and the leg rest rotated to a fully extended position.

Referring to FIG. 5, furniture member 10 is shown with the back support portion 14 rotated rearwardly to a fully reclined position achieved by an occupant supplied rearward force. Leg rest 28 is shown in a fully extended position following a counterclockwise rotation of leg rest extension device 26 in a lever arc of rotation "D" which actuates a pantograph linkage set 72 to extend leg rest 28. Extension of leg rest 28 does not by itself affect the rotational position of headrest portion 16. The rearward rotation of back support portion 14 about a back support recline arc of rotation "E" can affect the rotational position headrest portion 16 about the forward rotational direction "A" because an axis of rotation of back support portion 14 is defined through a rotational connector 73 which is offset forward and upward with respect to the axis of rotation defined through rotation pin 66.

Figure 6:
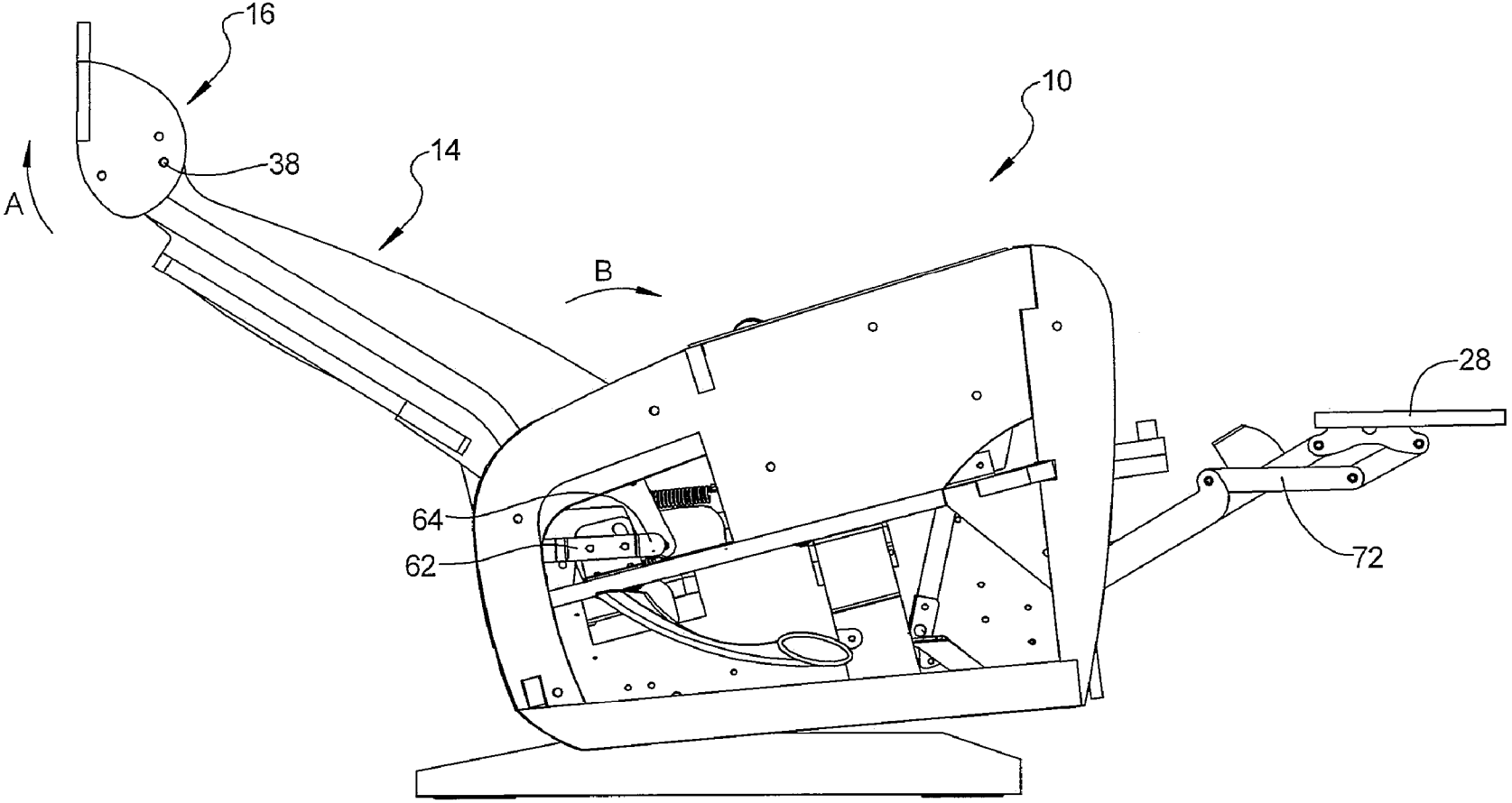
FIG. 6 is a side elevational view of the furniture member of FIG. 5 showing the headrest assembly rotated to the fully forward rotated position.

Referring to FIG. 6, when back support portion 14 is in the fully reclined position, headrest portion 16 can be further rotated in the forward rotation direction "A" by rotating actuation arm 62 in the actuation direction "B" as previously discussed herein. This allows the occupant to further move the headrest portion 16 in the forward rotation direction to increase support for the head of the occupant for example to improve visibility of a television or monitor. Headrest portion 16 can also be rotated in an opposite direction to actuation direction "B".

Figure 7:
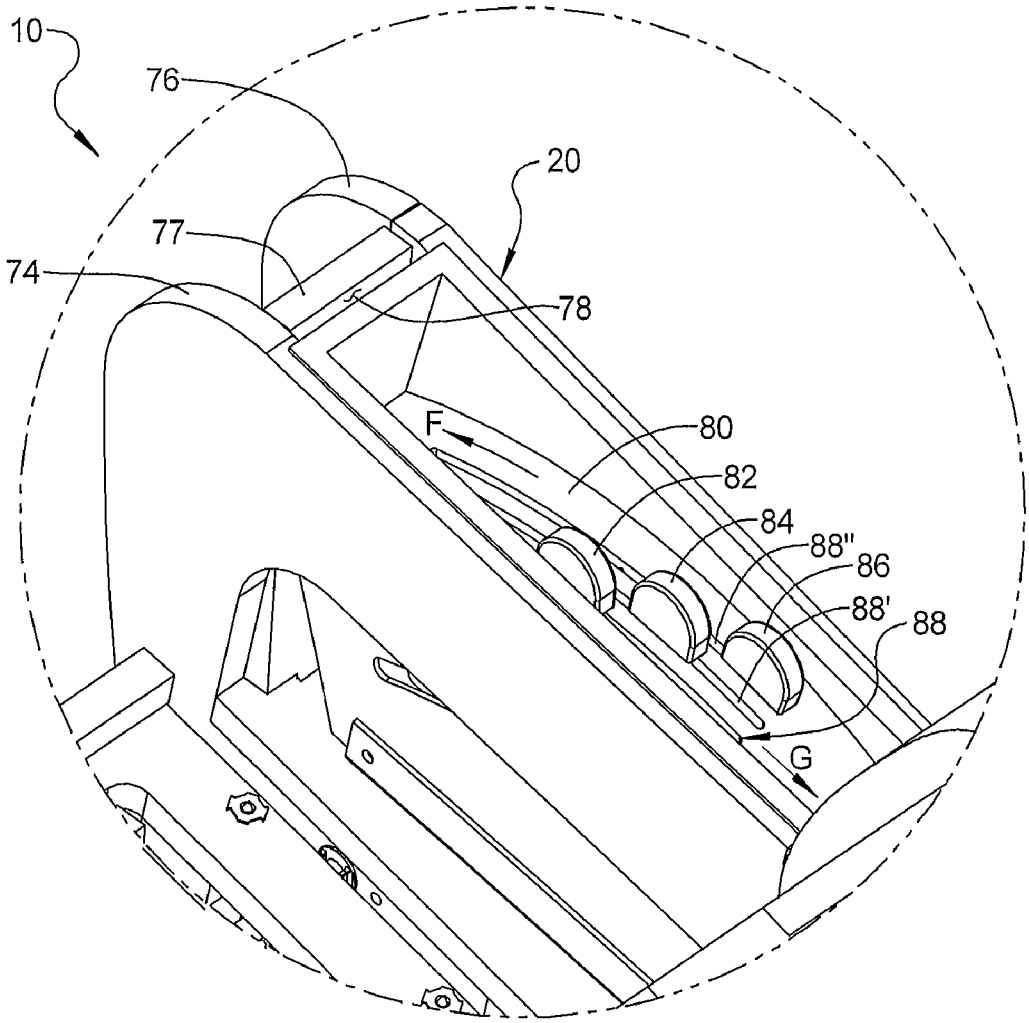
FIG. 7 is a top left perspective view of the first armrest member of the furniture member of FIG. 1.

Referring to FIG. 7, various control features can be incorporated in either the first or second armrest member 20, 22. According to several embodiments these controls can be provided between an interior armrest frame element 74 and an exterior armrest frame element 76 of first armrest member 20. The inclusion of a frame spacer member 77 between interior and exterior armrest frame elements 74, 76 creates a cavity 78. A mechanism housing face 80 supporting several sliding elements can be positioned in cavity 78 as shown. The sliding elements can include a lumbar adjustment slide 82, a headrest vertical adjustment slide 84, and/or a headrest fore/aft adjustment slide 86. Each of the adjustment slides can be positioned and guided within a guide slot 88 shown for example as guide slots 88, 88', 88". Each of the lumbar adjustment slide 82, the headrest vertical adjustment slide 84, and the headrest fore/aft adjustment slide 86 can be moved in either a slide forward direction "F" or a slide rearward direction "G". The slide elements are positioned to allow easy access to the occupant of furniture member 10 for manually displacing one of the lumbar adjustment slide 82, the headrest vertical adjustment slide 84, and/or the headrest fore/aft adjustment slide 86.

Figure 8:
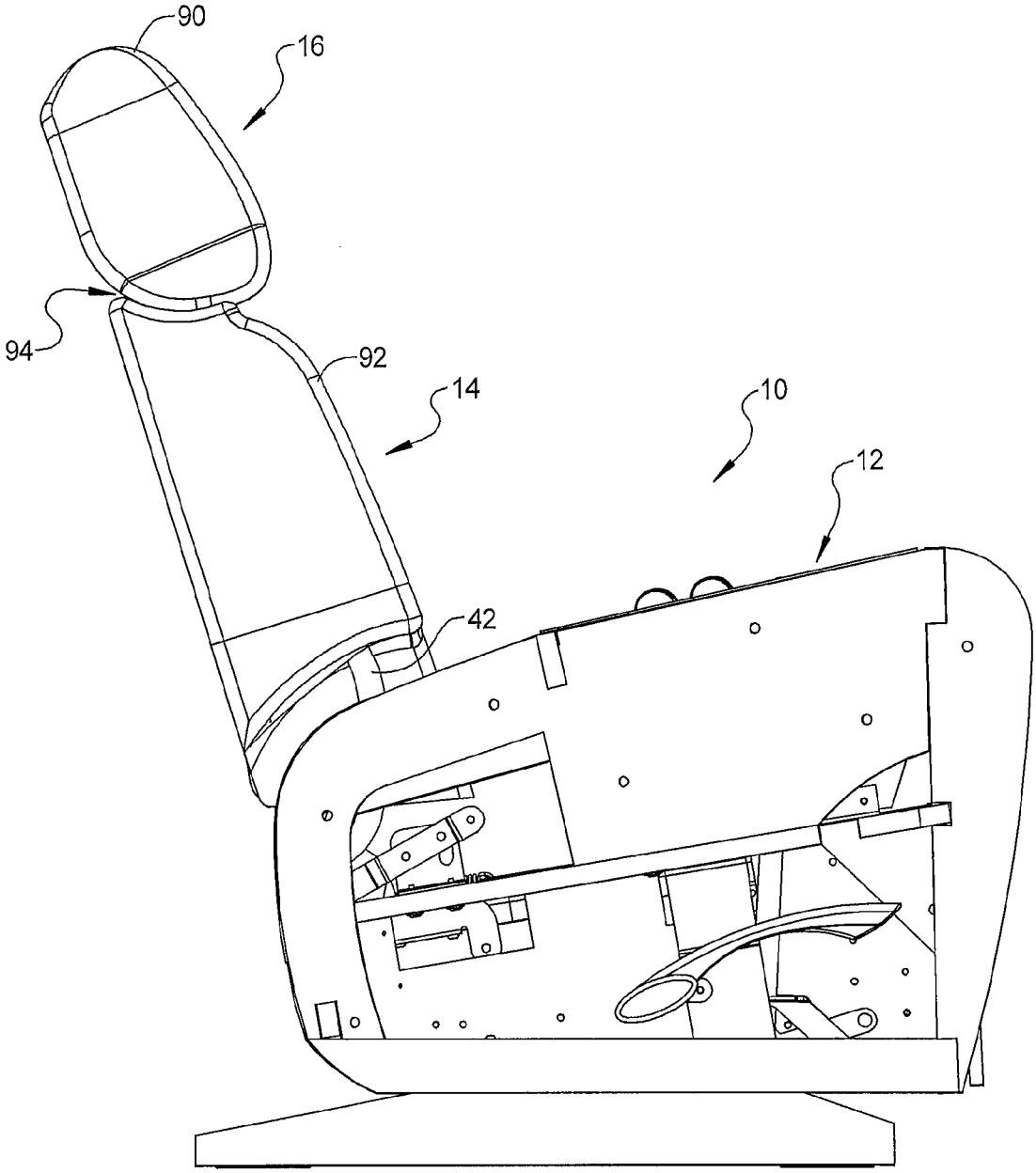
FIG. 8 is the side elevational view of the furniture member of FIG. 3 further showing headrest assembly and back support member upholstery applied over the frame.

Referring to FIG. 8, furniture member 10 is shown in the fully upright position of back support portion 14. A headrest upholstery cover 90 and a back support upholstery cover 92 are commonly applied over frame elements of furniture member 10. According to several embodiments, actuation link 42 is partially disposed between the headrest upholstery cover 90 and the back support upholstery cover 92 and a frame member so that actuation link 42 is substantially covered by upholstery throughout the operating positions of furniture member 10. An upholstery clearance gap 94 between headrest portion 16 and back support portion 14 is minimized in the fully rearward position of headrest portion 16.

Figure 9:
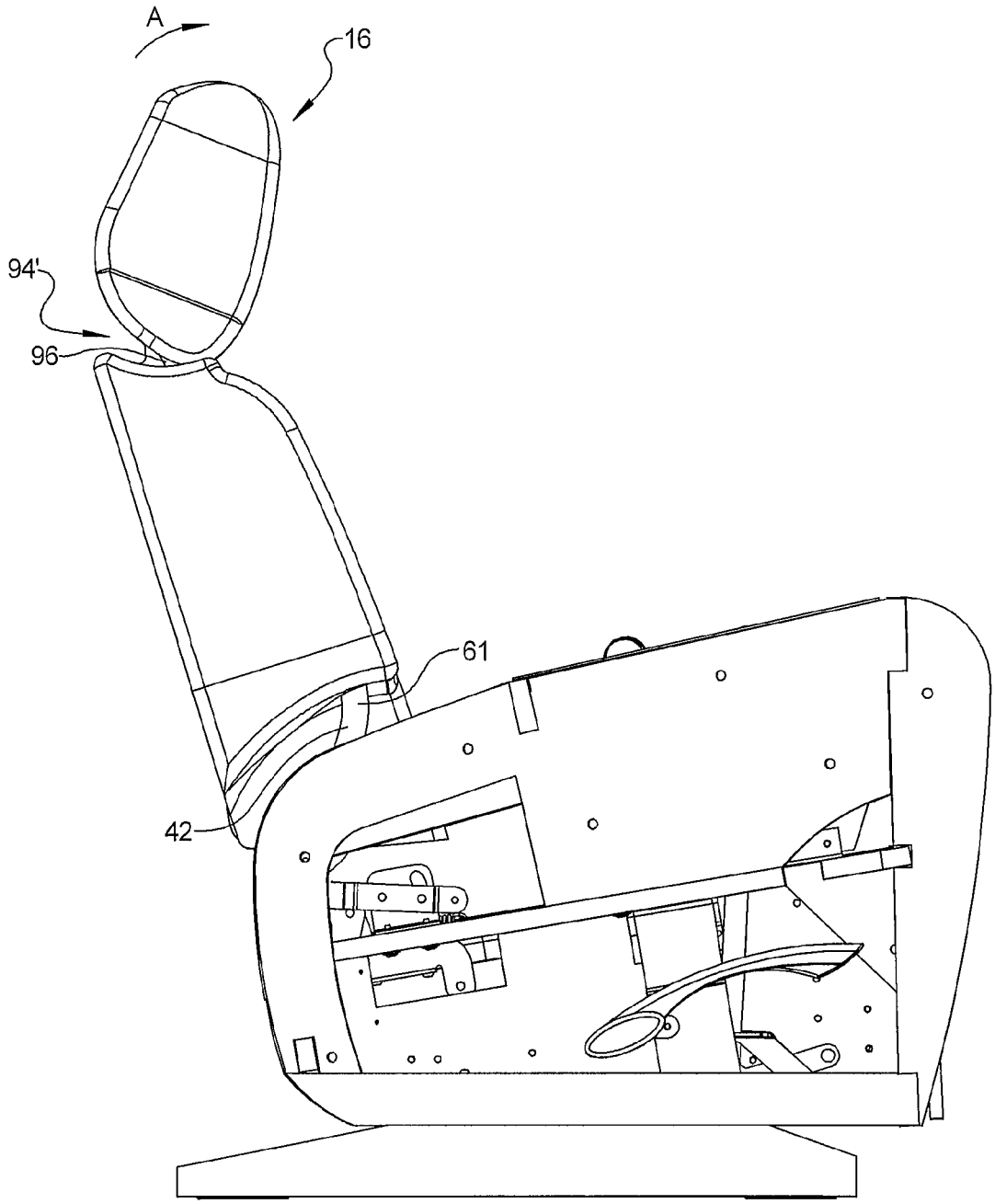
FIG. 9 is the side elevational view of the furniture member of FIG. 8 showing the headrest assembly rotated to the fully forward rotated position.

Referring to FIG. 9, by displacing actuation link 42, and rotating headrest portion 16 in the forward rotation direction "A", a modified upholstery clearance gap 94' increases and a link connecting end 96 of actuation link 42 can be partially visible. The intermediate bend portion 61 positions most of actuation link 42 forward (to the right as viewed in FIG. 9) to minimize the visible portion of link connecting end 96 in this headrest position.

Figure 10:
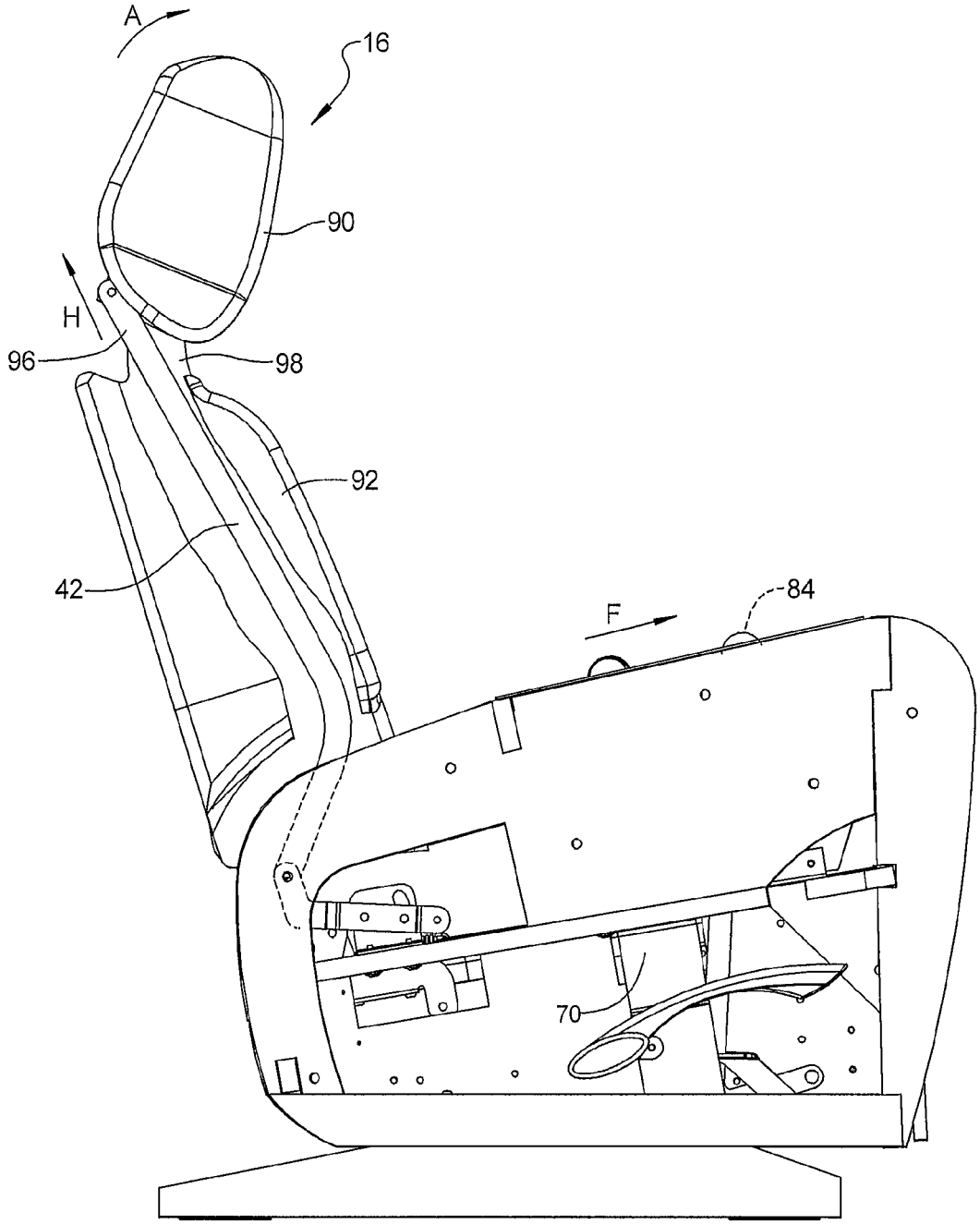
FIG. 10 is the side elevational view of the furniture member of FIG. 8 modified to show the headrest assembly rotated to the fully forward rotated position and a vertical extended position.

Referring to FIG. 10, a portion of both headrest upholstery cover 90 and back support upholstery cover 92 are removed for clarity. By displacing headrest vertical adjustment slide in the slide forward direction "F", headrest portion 16 is displaced in a headrest extension direction "H". The substantially upward or vertical extension of headrest portion 16 is provided independent of rotation in the forward rotation direction "A". This extension provides for additional support of the occupant's head to accommodate tall occupants. An extension mechanism 98 is provided to permit upward extension and downward return of headrest portion 16.

Figure 11:
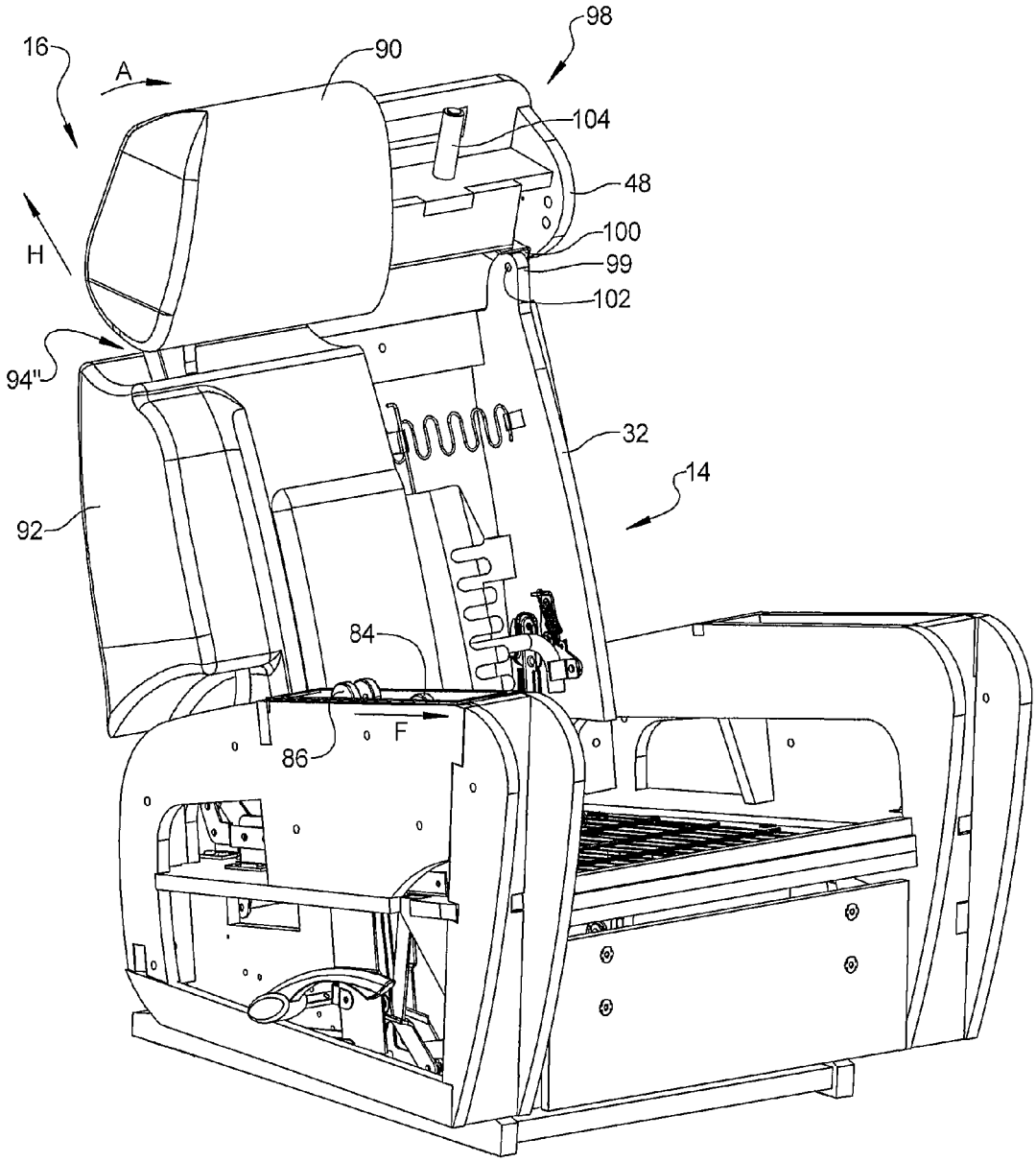
FIG. 11 is a right side perspective view of the furniture member shown in FIG. 10.

Referring to FIG. 11, headrest portion 16 is shown with maximum headrest 16 displacement in the headrest extension direction "H", in addition to maximum forward rotation in the forward rotation direction "A". This results in an upholstery clearance gap 94". With portions of headrest upholstery cover 90 removed for clarity, according to several embodiments a headrest extension bracket 100 is connected to second headrest side frame member 48. Headrest extension bracket 100 is rotatably connected to support structure 99 by a fastener such as a pin (not shown) disposed through a pin receiving aperture 102. A headrest support tube 104 (a second headrest support tube 104' is not shown in this view) can be used to provide biasing force during upward and downward movement of headrest portion 16. As previously noted, manually moving headrest vertical adjustment slide 84 in the slide forward direction "F" to its fullest extent provides maximum upward extension of headrest portion 16. Headrest fore/aft adjustment slide 86 is also available for moving headrest portion 16 in the forward rotation direction "A" or reversing that rotation to return headrest portion 16 to the fully retracted position.

Figure 12:
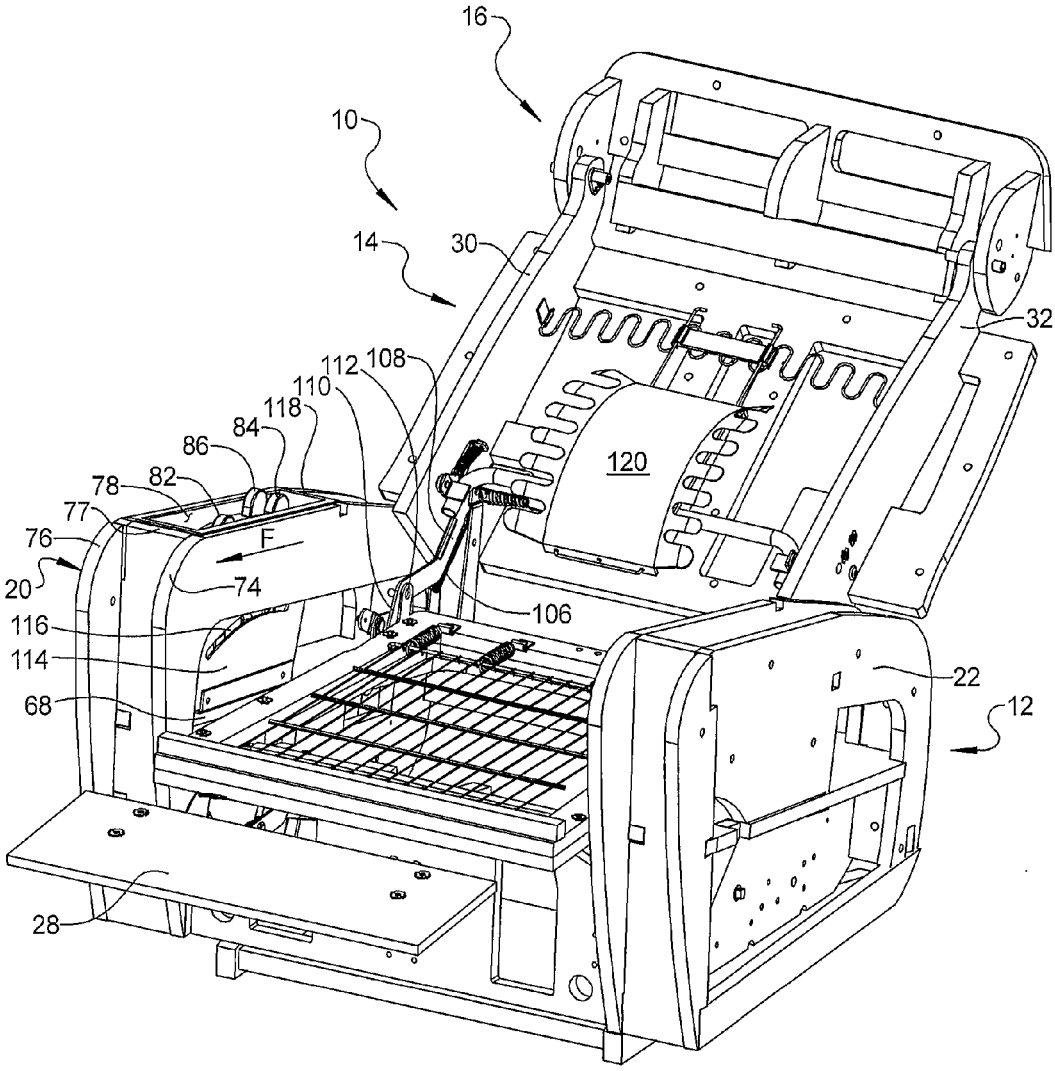
FIG. 12 is a left side perspective view of the furniture member of FIG. 1 with the leg rest in a fully extended position and the back support member in a fully reclined position.

Referring to FIG. 12, back support portion 14 can be rotatably connected to base portion 12 using a back support bracket 106 fixedly connected to each of the first and second side frame members 30, 32 (only the back support bracket 106 connected to first side frame member 30 is visible in this view). A back support link 108 which can have an L-shape is rotatably connected to a base connection bracket 110 which is fixedly connected to base portion 12. A portion of back support link 108 is slidably received in back support bracket 106 to releasably connect back support portion 14 to base portion 12. Back support portion 14 is then rotatable about an axis of rotation defined by a back support pin 112 which rotatably connects back support link 108 to base connection bracket 110.

A mechanism housing 114 is disposed in cavity 78 created between interior and exterior armrest frame elements 74, 76. A mechanism 116 which provides for sliding operation of each of the lumbar adjustment slide 82, the headrest vertical adjustment slide 84, and the headrest fore/aft adjustment slide 86 is disposed within mechanism housing 114. A second frame spacer member 118 is also provided which in addition to frame spacer member 77 establishes a width of cavity 78.

According to several embodiments an adjustable lumbar support device 120 can flex between a fully retracted position (shown in reference to FIG. 1) and a fully extended position shown in FIG. 12. The fully extended position of adjustable lumbar support device 120 is provided by sliding lumbar adjustment slide 82 in the slide forward direction "F" to its fullest extent. Adjustable lumbar device 120 is therefore manually extendable or retractable by the occupant of furniture member 10 to provide for infinite lumbar adjustment positions for the comfort of the occupant. It is noted any or all of the slides provided with mechanism 116 can also be provided within a similar mechanism disposed in a cavity of second armrest member 22.

Figure 13:
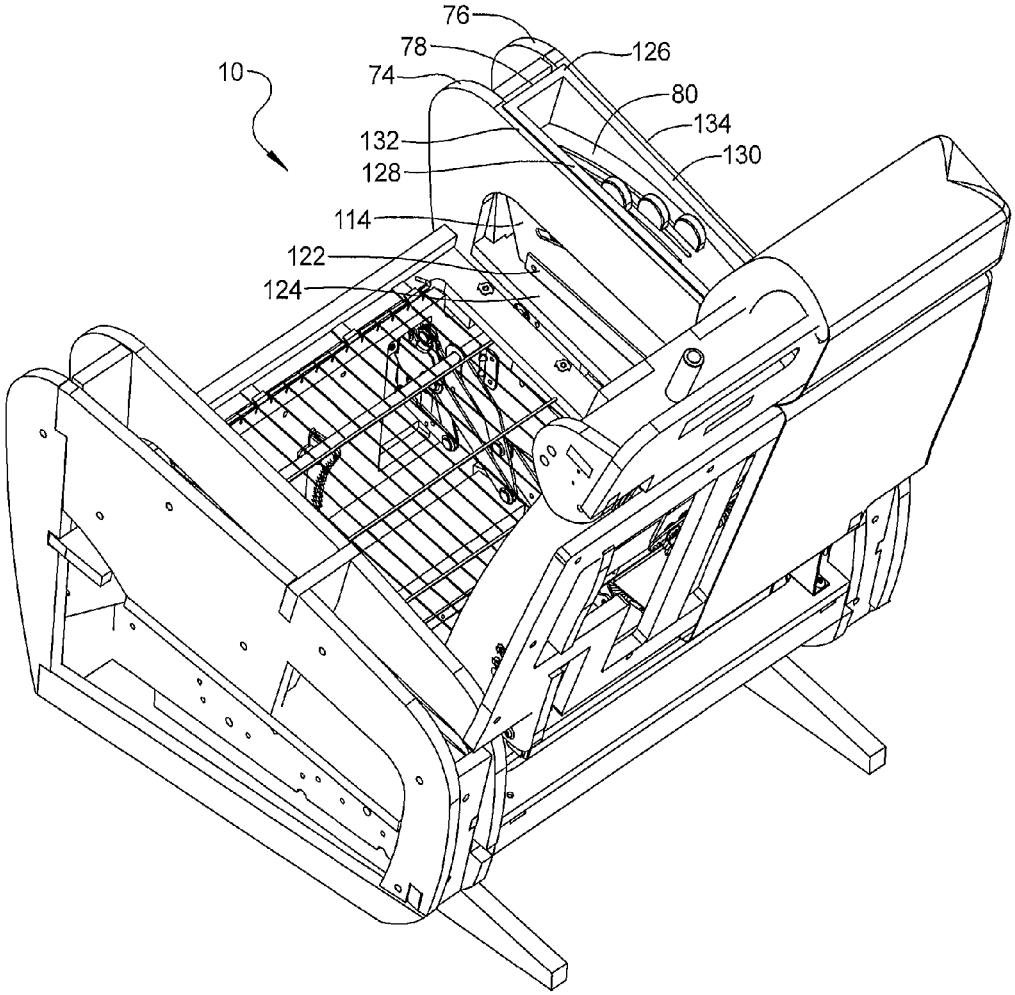
FIG. 13 is top left perspective view of the furniture member of FIG. 1.

Referring to FIG. 13, mechanism housing 114 can be further supported using a mounting bracket 122 connected for example by fasteners to an armrest frame member 124 positioned below mechanism housing 114 and in contact with mounting bracket 122. A cowl portion 126 which can be made for example as a polymeric molded part can include housing face 80. Cowl portion 126 can be positioned within cavity 78 providing an aesthetic cover for cavity 78. Cowl portion 126 can include a first flange 128 and a second flange 130 which extend outwardly and in contact with each of a first and second upper surface 132, 134 of the interior and exterior armrest frame elements 74, 76. A cover (not shown) which can also be upholstered can be provided to cover the entire assembly of the cowl portion 126 for the finished furniture member 10.

Figure 14:
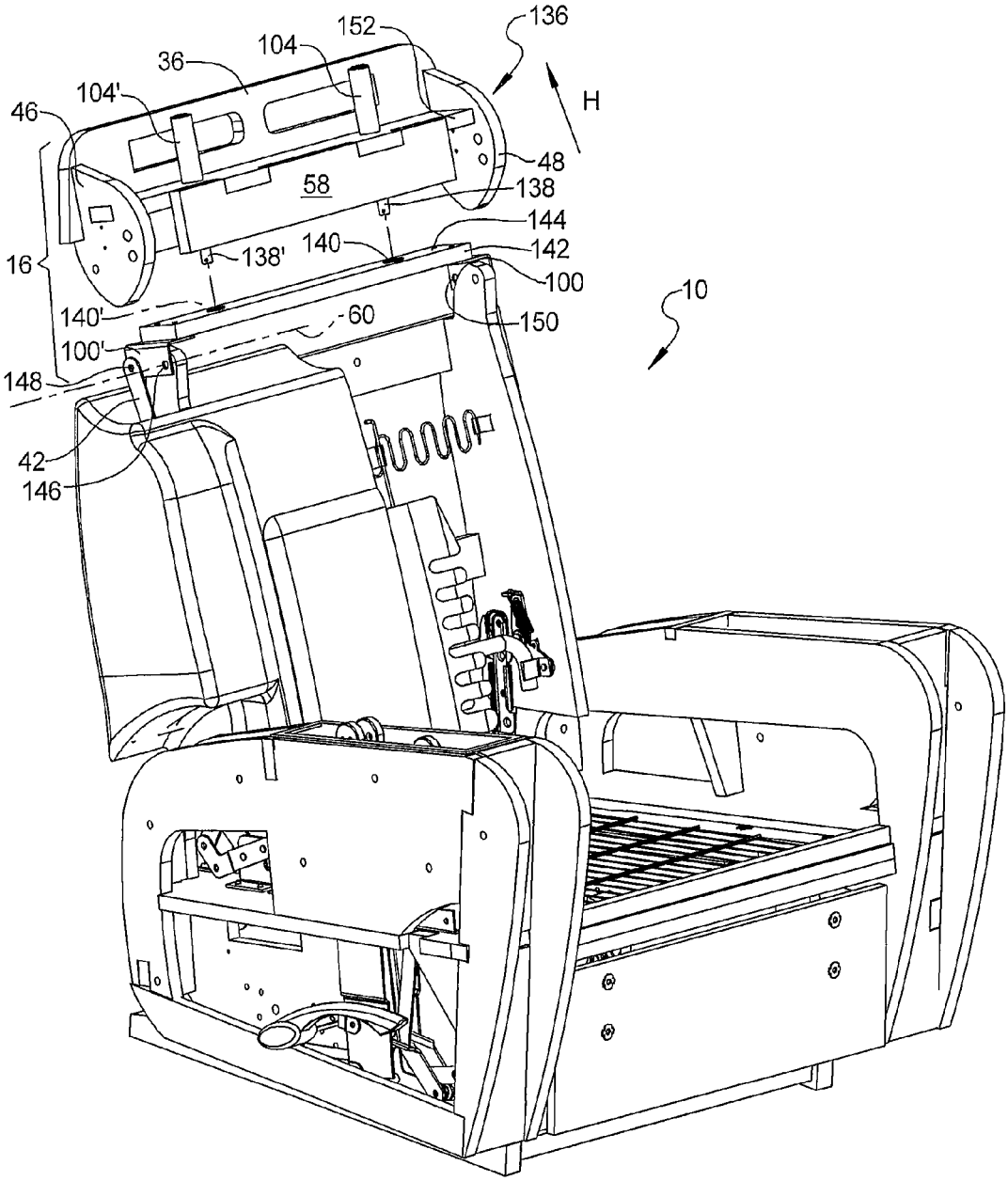
FIG. 14 is a front right perspective view of the furniture member showing a headrest subassembly separated from the back seat portion.

Referring to FIG. 14, headrest portion 16 can be further divided into a headrest subassembly 136 which includes first and second headrest side frame members 46, 48, headrest frame 36, and headrest forward frame member 58. First and second stiffening members 52, 54 and brace member 56 are not shown for clarity. First and second headrest extension tubes 138, 138' are retained within headrest support tubes 104, 104' and extend below forward frame member 58. First and second headrest extension tubes 138, 138' are slidably received in extension tube receiving apertures 140, 140' which are created in a rotatable frame member 142. Rotatable frame member 142 is fixedly attached to headrest extension brackets 100, 100' using fasteners 144.

With further reference to FIG. 14 and again to FIG. 1, headrest pin receiving apertures 146 rotatably receive first and second headrest pins 38, 40 to define pin longitudinal axis 60. A link pin receiving aperture 148 is coaxially aligned with a link pin sliding aperture 150 of headrest extension bracket 100' to rotatably receive link pin 44. A tube support member 152 of headrest subassembly 136 has headrest support tubes 104, 104' fixedly connected thereto. Headrest subassembly 136 can move in the headrest extension direction "H" by sliding motion of headrest extension pins 138, 138' in extension tube receiving apertures 14, 140'.

Figure 15:
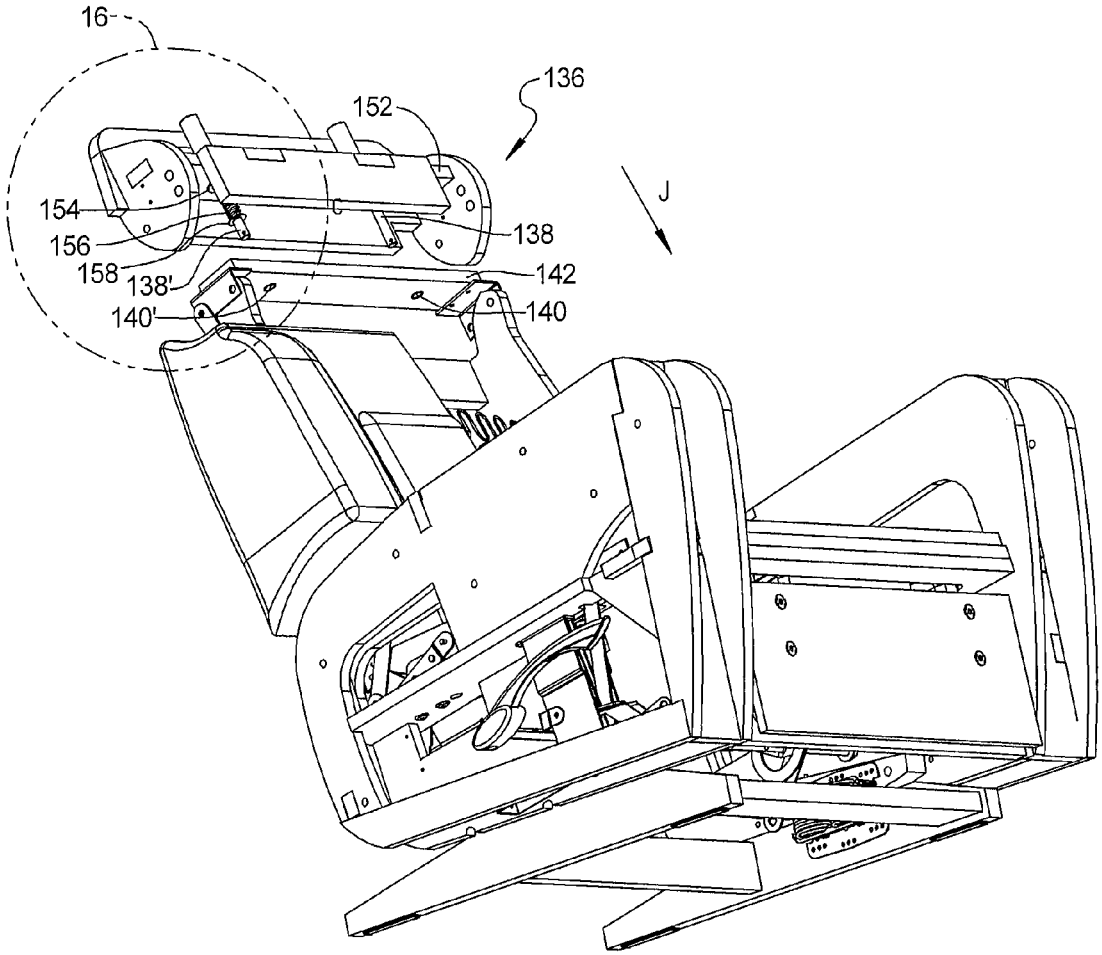
FIG. 15 is a front right lower perspective view of the furniture member of FIG. 14.

Referring to FIG. 15 and again to FIG. 1, each of the headrest extension tubes 138, 138' slidably receive a first washer 154, a compression spring 156, and a second washer 158. First and second washers 154, 158 have a diameter at least equal to or greater than a diameter of compression springs 156. When the headrest extension tubes 138, 138' are slidably received in receiving apertures 140, 140' and headrest subassembly 136 is pulled in a headrest downward direction "J" to the headrest lower position shown in FIG. 1, first washer 154 contacts an underside of tube support member 152 and second washer 158 contacts an upper surface of rotatable frame member 142, thereby compressing compression springs 156.

Figure 16:
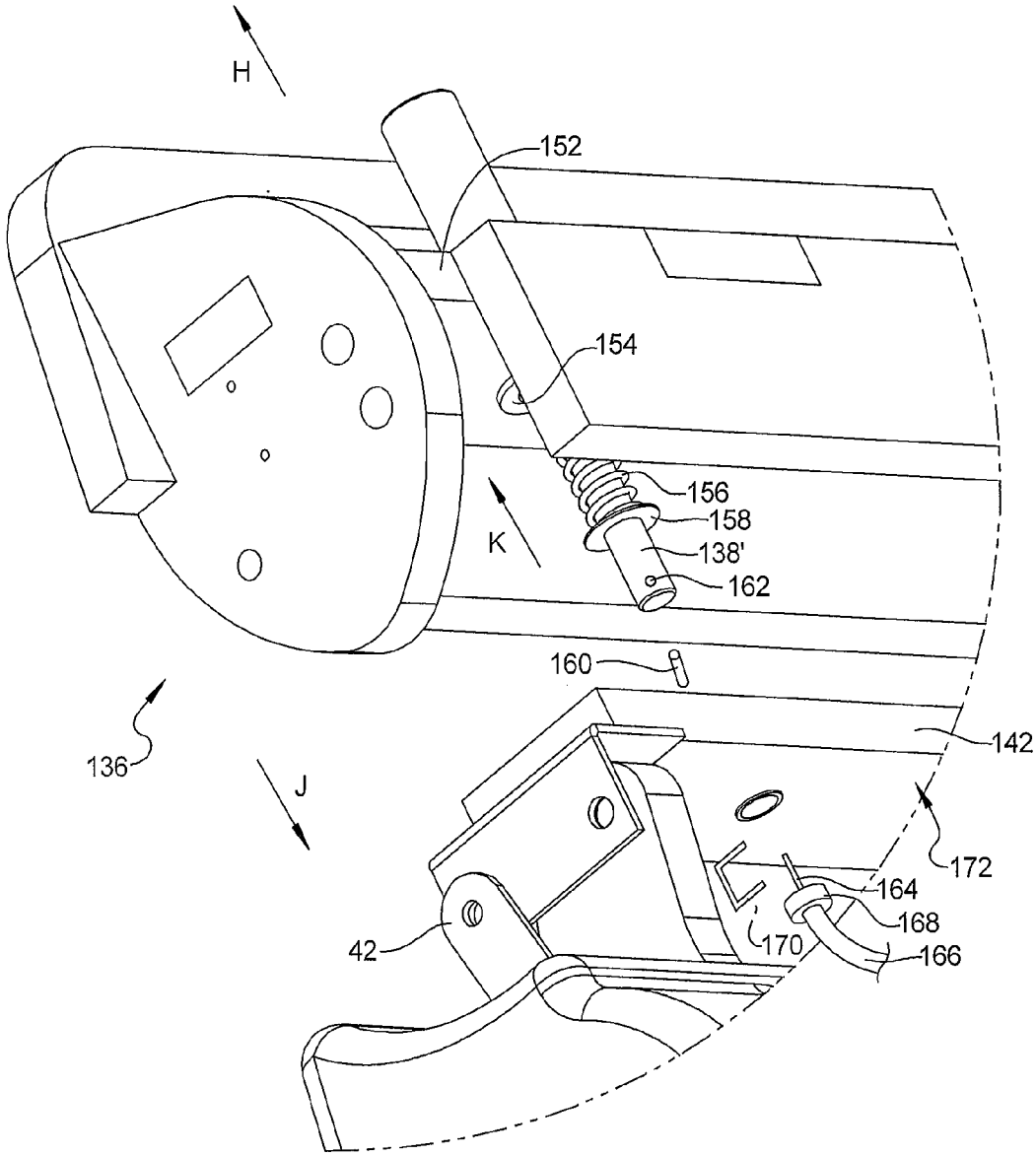
FIG. 16 is a front perspective view of area 16 of FIG. 15.

Referring to FIG. 16, when headrest subassembly 136 is pulled downward in the headrest downward direction "J" until second washer 158 contacts the upper surface of rotatable frame member 142, but before any compression of compression springs 156 occurs, a pin 160 is disposed in a pin receiving aperture 162 of each of the headrest extension tubes 138, 138' and located below rotatable frame member 142. Pins 160 prevent release of headrest subassembly 136 from back support portion 12. A cable 164 can be connected to each of the pins 160 or singularly connected to an intermediate position of tube support member 152 between headrest support tubes 104, 104'. Cable 164 is slidably received in a cable sheath 166. Cable sheath 166 is held in place with respect to rotatable frame member 142 by a connector 168 fixed to a free end of cable sheath 166. Connector 168 is in turn fixedly connected to a bracket 170 and bracket 170 is connected to a lower surface 172 of rotatable frame member 142. With cable sheath 166 fixed, sliding displacement of cable 164 can pull pin 160 and therefore headrest extension tubes 138, 138' (or alternately tube support member 152) downward to move headrest subassembly 136 in the downward direction "J", compressing compression springs 156 between rotatable frame member 142 and tube support member 152.

With further reference to FIG. 16 and again to FIGS. 1 and 7, by sliding headrest vertical adjustment slide 84 in the slide forward direction "F", tension on cable 164 is released and the spring force of compression springs 156 pushes tube support member 152 away from rotatable frame member 142, moving headrest subassembly 136 in the headrest extension direction "H". Movement in the headrest extension direction "H" or downward direction "J" is not limited by the rotated position of headrest portion 16 or the position of actuation link 42.

An adjustable headrest assembly of the present disclosure offers several advantages. The headrest assembly 16 can be rotated forwardly and rearwardly to provide additional or reduced support for the head of an occupant of the furniture member. The headrest assembly 16 can also be upwardly extended which provides support for taller occupants. By providing actuation link 42 which includes an intermediate bend portion 61, the actuation link 42 can be completely retained within the upholstered or finished covering of furniture member 10 for substantially all of the movements of the back support portion 14 as well as the rotated and extended positions of headrest portion 16. By enclosing a mechanism housing between interior and exterior frame elements of the armrest members of furniture member 10, the mechanism and mechanism housing are completely retained within the armrest member allowing access to various levers for controlling the rotated position of the headrest assembly as well as extending or retracting a lumbar support assembly. The various levers for controlling these features are available in an upward facing portion of the armrest member(s) so each of the levers is visible to an occupant of the furniture member without having to reach to the side of the armrest member for a control feature which may not be easily visible to the occupant. By further including an actuation assembly 45 which transmits the force of one of the levers of the mechanism to actuation link 42 within the space envelope of the armrest member(s), substantially all of the moving components that control the positions of the headrest assembly 16 and the lumbar support assembly are enclosed either within the frame structure or the upholstered finished pieces of furniture member 10 so they are completely contained away from direct access of the occupant as well as providing an aesthetic finished appearance for furniture member 10.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A furniture member headrest control system, comprising:

an armrest portion of a furniture member having interior and exterior armrest frame elements;

a back support portion connected to the armrest portion;

a headrest portion movably connected to the back support portion;

a first adjustment member operable to rotate the headrest portion, the first adjustment member positioned in a cavity created between the interior and exterior armrest frame elements, the first adjustment member manually movable by an occupant of the furniture member;

an actuation arm rotated by a force received from the first adjustment member; and an actuation link rotatably connected at a first end to the headrest portion and at a second end to the actuation arm, such that rotation of the actuation arm operates to displace the actuation link to rotate the headrest portion to a plurality of headrest support positions.

2. The system of claim 1, further comprising:

a bracket fixed to the armrest portion; and a rotation pin rotatably connecting the actuation arm to the bracket.

3. The system of claim 2, further comprising:

a connecting pin rotatably joining the first end of the actuation link to the headrest portion; and at least one second rotation pin rotatably connecting the headrest portion to the back support portion, the at least one second rotation pin being spaced from the connecting pin such that displacement of the actuating link induces rotation of the headrest portion.

4. The system of claim 1, wherein the back support portion includes parallel first and second side frame members.

5. The system of claim 4, further comprising:

opposed first and second headrest frame members of the headrest portion; and first and second fasteners, the first fastener disposed through both the first side frame member and the first headrest frame member, and the second fastener disposed through both the second side frame member and the second headrest frame member, the first and second fasteners defining an axis of rotation of the headrest portion.

6. The system of claim 1, further comprising a mechanism positioned in the cavity adapted to support the first adjustment member, the first adjustment member defining a lever movable in a longitudinal slot of the mechanism, the lever being directly manually displaceable.

7. The system of claim 6, further including a second adjustment member operating when displaced to upwardly extend the headrest portion, the second adjustment member defining a second lever movable in a second longitudinal slot of the mechanism and positioned proximate to the first adjustment member, and manually movable by the occupant of the furniture member.

8. The system of claim 1, further comprising:

first and second side frame members of the back support portion;

a rotatable frame member rotatably pinned to the first and second side frame members;

a headrest subassembly having at least one headrest extension tube slidably disposed through an aperture of the rotatable frame member; and a second adjustment member operating to move the headrest subassembly upwardly with respect to the back support portion.

9. The system of claim 8, further comprising a biasing member retained on the at least one headrest extension tube and compressible when the headrest subassembly is moved toward the rotatable frame member, a biasing force of the biasing member operating to bias the headrest subassembly away from the back support portion.

10. A furniture member headrest control system, comprising:

an armrest portion fixedly connected to a base portion of a furniture member;

a back support portion connected to the armrest portion;

a headrest portion movably connected to the back support portion;

a first adjustment member operating to rotate the headrest portion, the first adjustment member positioned in a cavity created between interior and exterior armrest frame elements of the armrest portion and manually movable by an occupant of the furniture member; and a second adjustment member operating to upwardly and downwardly move the headrest portion with respect to the back support portion, the second adjustment member positioned in the cavity and manually movable by the occupant; and an actuation link rotatably connected at a first end to the headrest assembly and linked at a second end to the first adjustment member, such that movement of the first adjustment member displaces the actuation link to rotate the headrest assembly to a plurality of support positions.

11. The system of claim 10, further comprising a mechanism adapted to rotatably support the first and second adjustment members, the mechanism being disposed in a housing connected to the armrest portion within the cavity.

12. The system of claim 10, further including an actuation assembly positioned in the cavity, the actuation assembly including:

an actuation arm rotatably connected to the actuation link;

a bracket fixed to the armrest portion; and a rotation pin rotatably connecting the actuation arm to the bracket.

13. The system of claim 12, further including a cable slidably disposed in a cable sheath, the cable connected to each of the first adjustment member and the actuation arm, wherein displacement of the first adjustment member translates the cable in the cable sheath and rotates the actuation arm about the rotation pin to displace the actuation link.

14. The system of claim 10, further comprising:

first and second side frame members of the back support portion;

a rotatable frame member rotatably pinned to the first and second side frame members;

a headrest subassembly of the headrest portion having at least one headrest extension tube slidably disposed through an aperture of the rotatable frame member.

15. The system of claim 14, further comprising a biasing member retained on the at least one headrest extension tube and compressible when the headrest subassembly is moved toward the rotatable frame member, a biasing force of the biasing member operating to bias the headrest subassembly away from the back support portion.

16. The system of claim 15, further including a cable slidably disposed in a cable sheath, the cable connected to each of the second adjustment member and the headrest subassembly.

17. The system of claim 16, wherein displacement of the second adjustment member in a first direction translates the cable in the cable sheath to pull the headrest subassembly toward the rotatable frame member, compressing the biasing member; and wherein displacement of the second adjustment member in a second direction translates the cable in the cable sheath in a direction toward the headrest subassembly to allow the biasing force of the biasing member to displace the headrest subassembly away from the rotatable frame member.

18. A furniture member headrest control system, comprising:

a mechanism having at least first and second lever members;

an actuation assembly connected to the first lever member;

an actuation link connected between the actuation assembly and a headrest portion, manual movement of the first lever member operating to rotate the headrest portion between a rearward rotated position and a forward rotated position; and a cable linking the second lever member to a headrest subassembly of the headrest portion, manual movement of the second lever member operating to displace the cable thereby displacing the headrest subassembly between a downward position and an upward extended position.

19. The furniture member headrest control system of claim 18, further including interior and exterior armrest frame elements of an armrest portion defining a cavity of the armrest portion, the mechanism connected to the armrest portion and positioned within the cavity.

20. The furniture member headrest control system of claim 18, further comprising:

a frame member rotatably pinned to a back support portion;

a headrest subassembly of the headrest portion having a headrest support tube;

a headrest extension tube slidably disposed in the headrest support tube and slidably received in an aperture of the frame member; and a biasing member retained on the headrest extension tube and compressible when the headrest subassembly is moved toward the frame member, a biasing force of the biasing member operating to bias the headrest subassembly away from the back support portion.

21. The furniture member headrest control system of claim 18, further including a second cable connecting the first lever member to an actuation arm of the actuation assembly, the second cable axially translated within a sheath by movement of the first lever member to rotate the actuation arm of the actuation assembly.

22. The furniture member headrest control system of claim 21, further including:

a bracket having an arcuate slot, the actuation arm rotatably connected to the bracket by a rotation pin, and an extending pin connected to the actuation arm and movably received in the arcuate slot such that rotation of the actuation arm is limited by contact of the extending pin with opposed ends of the arcuate slot.

23. A method for adjusting a position of a headrest portion of a furniture member, the furniture member including a base portion, an armrest portion fixed to the base portion, a back support portion connected to the armrest portion, and first and second lever members both movable in a first direction and an opposite second direction, the method comprising:

displacing the first lever member in the first direction to rotate the headrest portion from a headrest back position to a headrest forward position;

restraining the headrest portion in a headrest retracted position against a biasing force of a biasing element; and displacing the second lever member in the first direction to allow the biasing force of the biasing member to upwardly extend the headrest portion away from the back support portion to a headrest extended position.

24. The method of claim 23, comprising moving the first lever member in the second direction to return the headrest portion to the headrest retracted position.

25. The method of claim 23, comprising moving the second lever member in the second direction to pull the headrest portion toward the back support portion and compress the biasing member.

26. The method of claim 23, comprising utilizing a first actuation system to connect the first lever member to the headrest portion.

27. The method of claim 26, comprising providing a second actuation system independent of the first actuation system to connect the second lever member to the headrest portion.

* * * * *